United States Patent [19]

Hudgins

[11] 4,256,286

[45] Mar. 17, 1981

[54] POST PULLING DEVICE

[76] Inventor: Jimmy R. Hudgins, Rte. 2, Hermleigh, Tex. 79526

[21] Appl. No.: 89,473

[22] Filed: Oct. 30, 1979

[51] Int. Cl.[3] ..... E21B 19/00

[52] U.S. Cl. ..... 254/30

[58] Field of Search ..... 254/29 R, 30–31, 254/132

[56] References Cited

U.S. PATENT DOCUMENTS

| | | | |
|---|---|---|---|
| 3,129,924 | 4/1964 | Froh | 254/29 R |
| 3,647,185 | 4/1972 | Phibbs | 254/30 |
| 3,726,506 | 4/1973 | Vanderwaal et al. | 254/29 R |

*Primary Examiner*—Robert C. Watson

*Attorney, Agent, or Firm*—Harvey B. Jacobson; Clarence A. O'Brien

[57] ABSTRACT

A frame having a pair of upstanding side members is attached to the three point hitch of a tractor. The frame includes a base which can rest upon the ground adjacent a post to be removed from the ground. A plate is slidably attached for vertical movement along the side members and includes a hydraulically operated clamp for attachment to the post. A hydraulic cylinder is attached between the top of the frame and the plate and pulls the frame vertically after the clamp is attached to the post.

5 Claims, 6 Drawing Figures

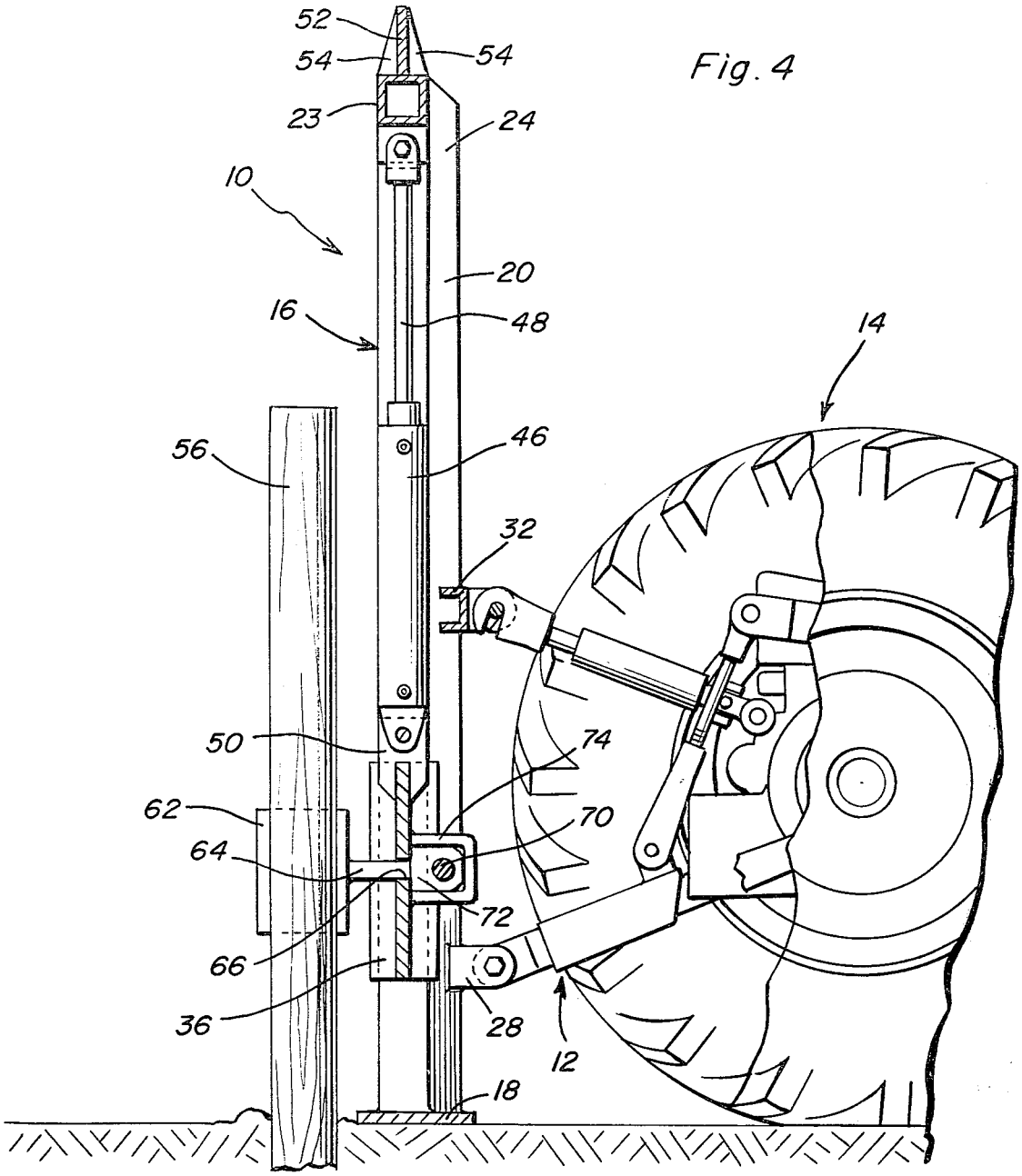
Fig. 4
Fig. 5
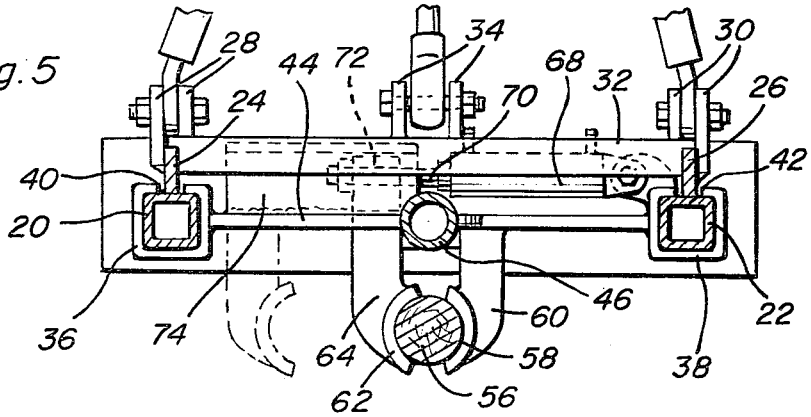
Fig. 6
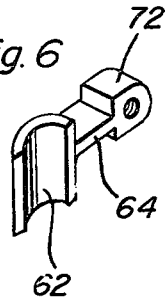

POST PULLING DEVICE

BACKGROUND OF THE INVENTION

1. Field of the Invention

This invention relates to post pulling implements and especially to such implements which can be conveniently attached to the three point hitch of a tractor.

2. Discussion of Related Art

Fence maintenance requiring removal of old fence posts and replacement with new posts is often a laborious and time consuming job. It is, therefore, desirable to effect the removal of old posts with as little time and energy consumed as is possible. This then calls for a mechanized device which can easily be transported to and from the various posts requiring removal.

Several devices of this type have been suggested. For instance, U.S. Pat. No. 2,482,950, issued Sept. 27, 1949, to Toftey, shows a post puller which is connectible to the three point hitch of a tractor. The Toftey device includes a pair of transverse rock shafts which are supported in longitudinally spaced relation on a frame member with one of their ends projecting laterally from a side of the frame member. A pair of post-engaging arms oppositely arranged on the rock shafts are mounted for movement between closed positions in a substantially common plane and open positions extending upwardly and inwardly toward each other. The jaws are initially engaged with the post and the frame is elevated by use of the three point hitch. U.S. Pat. No. 3,525,502, issued Aug. 25, 1970, to Fisher, shows a post puller comprising a frame structure detachably secured to the side of a tractor. The slide structure is reciprocally supported by the frame for movement laterally with respect to the longitudinal axis of the tractor and a vertical mast is supported on one end of the slide structure for movement therewith. There is provided on the mast a puller frame assembly which is movable up and down with respect to the mast and which has engagement means thereon for effecting detachable engagement with a post. An extensible frame assembly is provided adjacent the lower end of the mast and is moved into ground engaging position when it is desired to pull a post from the ground. The puller frame assembly is then moved upwardly and thus pulls the post from the ground. U.S. Pat. No. 3,647,185, issued Mar. 7, 1972, to Phibbs, shows a pulling implement which includes a pair of opposed pivotally connected gripping jaws with the toggle linkages arranged to exert force to close the jaws on an object to be pulled when the supporting framework is raised. U.S. Pat. No. 4,026,522, issued May 31, 1977, to Dranselka, shows a self-engaging post pulling apparatus which is adapted for attachment to the rear lifting mechanism of most tractors. The apparatus comprises a horizontal support having two opposed plates pivotably mounted for frictionally engaging a post positioned therebetween. The plates are biased into a gripping position by helical springs, but may be remotely moved to a non-gripping position by cables affixed to the plates.

SUMMARY OF THE INVENTION

One object of the present invention is to provide a post pulling device which can easily be attached to the three point hitch of a tractor for transportation to and from a post pulling site.

A further object of the present invention is to provide a post pulling device which can be positioned in ground contacting engagement during the pulling process in order to avoid use of the hitch in the pulling operation.

Yet another still further object of the present invention is to provide a post pulling device which can be operated by a single person.

Another further object of the present invention is to provide a post pulling device which can be easily connected to the existing hydraulic system of a tractor.

In accordance with the above objects, the post pulling device of the present invention includes an upstanding rectangular framework having a base and two upstanding side members. The three point hitch of a tractor is connected to the lower portion of the upstanding side members and also to a center cross bar attached between the side members. A plate has a pair of sleeves attached to its ends which sleeves are positioned in surrounding relation to the side members for vertical movement thereon. A first hydraulic cylinder is connected between a top member of the frame and the plate. A pair of clamping jaws are attached to the plate with one jaw being fixed thereto and a second jaw being movable parallel to the front surface of the plate. The movable jaw is connected to a second hydraulic cylinder. The frame is positioned with the fixed jaw against a post to be pulled and the base of the frame in ground engaging position close to the post. The movable jaw is actuated to grasp the post and the vertical hydraulic cylinder moves the plate and jaws upwardly pulling the post from the ground.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a side elevational sectional view taken substantially along a plane passing through section line 4—4 of FIG. 1.

FIG. 5 is a top plan sectional view taken substantially along a plane passing through section line 5—5 of FIG. 1.

FIG. 6 is a perspective view of the movable jaw of the clamping device.

DESCRIPTION OF THE PREFERRED EMBODIMENT

Figure 1:
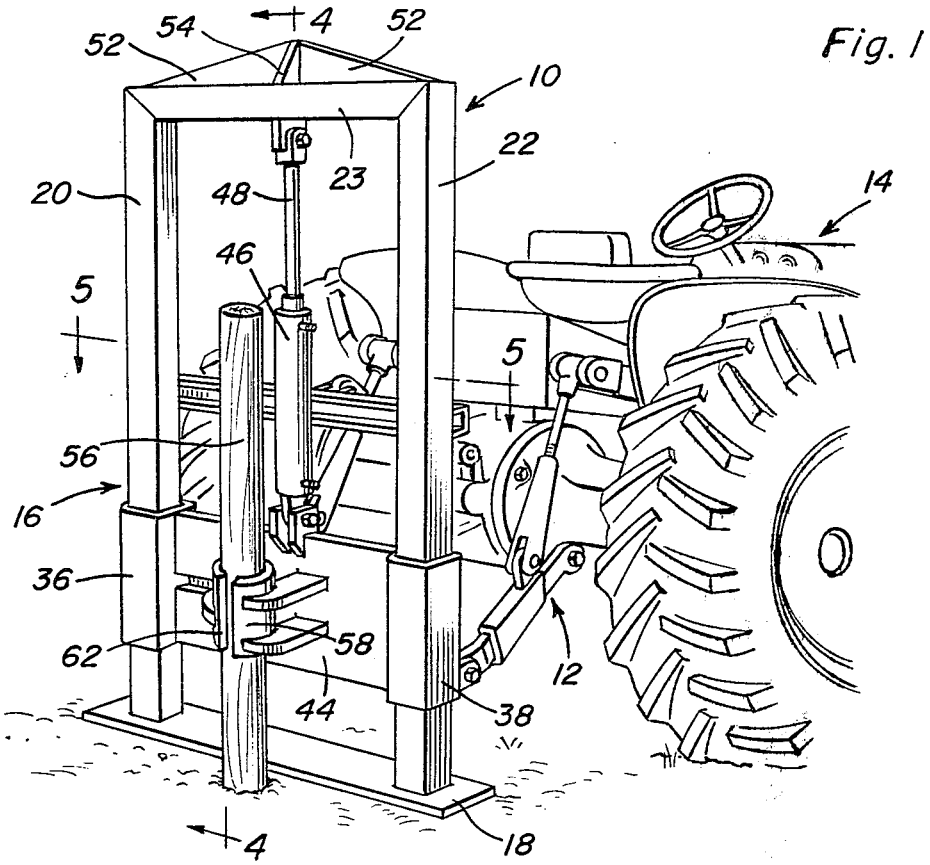
FIG. 1 is a perspective view of the post pulling device in operation.
Figure 2:
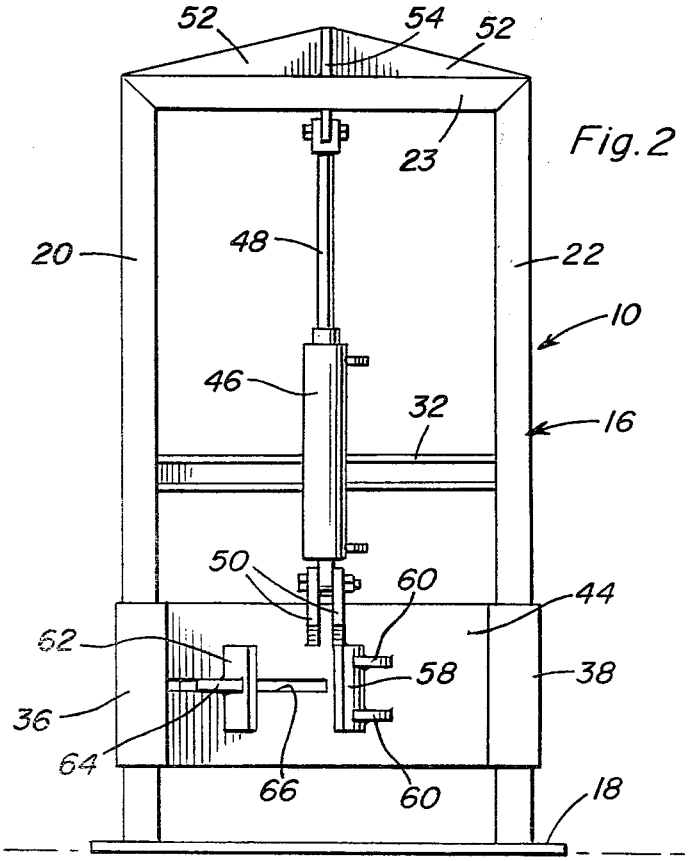
FIG. 2 is an elevational view of the post pulling device.
Figure 3:
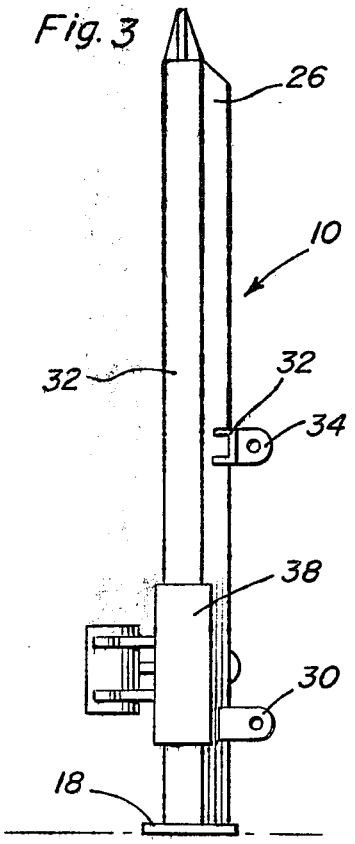
FIG. 3 is a side elevational view of the post pulling device.

Now with reference to the drawings, a post pulling device incorporating the principles and concepts of the present invention and generally referred to by the reference numeral 10 will be described in detail. It will be noted that the post pulling device 10 can be connected to a three point hitch 12 of a standard tractor 14. In this manner, the three point hitch can be raised lifting the frame 16 from ground engaging relationship and the entire device 10 can be easily transported. At the same time, when use of the device 10 is not required, it can easily be removed from the tractor 14 and the tractor used for other purposes.

The frame 16 includes a base plate 18 which is the ground engaging element of the device. Attached to the base plate are a pair of upstanding side members 20 and 22 which are connected at their upper ends by a top frame member 23. Each side member comprises a rectangular steel frame section attached to a substantially planar flange. The flanges 24 and 26 mount the attachment points for the three point hitch. Two attachment points comprise mounting boss pairs 28 and 30, respectively. The third attachment point includes a cross member 32 which is welded between the flanges 24 and 26. A pair of bosses 34 are welded to the cross member and serve as the connection point. The flanges 24, 26 are used in order that the bosses 28, 30 and the cross member 32 can be mounted at a position spaced from the surface of side members 20, 22. This spacing is required in order that there is room on each face of each side member to accommodate sleeves 36, 38 which slide vertically along the side members 20, 22, respectively. Each sleeve is essentially a rectangular box beam section having an inner circumference slightly larger than the outer circumference of the side members. Slots 40, 42 are cut into the sleeves to provide a space through which the flanges 24, 26 extend. A plate 44 is welded between the sleeves 36, 38 and travel with them throughout their vertical movement. Vertical movement of the plate and sleeves is effected through the use of hydraulic cylinder 46, the piston 48 of which is pivotally mounted to a boss extending downwardly from the top member 23. The piston body is attached to a pair of bosses 50 which are connected directly to plate 44. The cylinder 46 can be attached to the existing hydraulic system of the tractor 14 with valves appropriately mounted to allow actuation of the cylinder from the driver's seat. Accordingly, it can easily be seen that when a post is connected to the plate 44, cylinder 46 is actuated to pull plate 44 upwardly. In order to accommodate the strain of such an endeavor, a pair of gussets 52 are connected to the top member 23 longitudinally thereof and another pair of gussets 54 are connected laterally of the top member 23.

Post 56 is held stationary relative to the plate 44 and sleeves 36, 38 through the use of a clamping mechanism which includes a stationary jaw 58 which is welded directly to the plate 44 in approximately the middle of the plate. Stationary jaw 58 can be spaced from the plate by the use of a pair of mounting arms 60. A movable jaw 62 is welded to a single mounting arm 64 which extends through a slot 66 formed in the plate 44. The jaw 62 and the mounting arm 64 can move linearly in the slot 66 to clamp or release a post 56 contained between the jaws 62 and 58. In order to provide adequate clamping pressure, a hydraulic cylinder 68 is mounted behind the plate 44 with one end pivotally attached to sleeve 38. The piston 70 is received in the enlarged end of mounting arm 64 which is shown generally at 72. The enlarged end 72 slides on the tractor side of plate 66 and has one surface which abuts that plate. End 72 is substantially rectangular in shape and fits within a channel member 74 which is welded to plate 44 and serves as a guide for the mounting arm 64.

In operation, once the post pulling device 10 is attached to the three point hitch 12, the hitch can be raised and the device 10 transported to the site at which it is to be used. The tractor 14 is backed to the post 56 and the three point hitch 12 is lowered so that base 18 contacts the ground in the vicinity of the post. The tractor is maneuvered so that stationary jaw 58 contacts one side of the post. Cylinder 68, which may also be connected to the hydraulic system of the tractor and should be provided with a operating valve which is actuatable from a position in the driver's seat, is actuated drawing the movable jaw 62 into engagement with the post. The cylinder 46 is then actuated drawing the plate 44 together with sleeves 36 and 38 upward to draw the post 56 from the ground. Naturally, the post can be carried by the post pulling device to a desired position for disposal or the clamps can be released as soon as the post is pulled from the ground and the tractor moved to another position to remove additional posts from the ground.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pulling device comprising, in combination:

an upstanding frame, a ground engaging base connected at the bottom of said frame;

a plate member slidably connected to said frame for vertical movement along said frame;

powered means connected between said frame and said plate member for causing powered movement of said plate; and clamp means attached to and movable with said plate member for clamping a post to be removed from the ground, said frame including a pair of side members, a pair of sleeves at least partially surrounding each of said side members and attached to said plate for slidably connecting said plate to said side members, said clamp means including one fixed jaw attached to said plate and one movable jaw slidably connected to said plate, jaw movement means connected to said movable jaw for causing movement of said jaw movable to and from said fixed jaw, said frame including a top member extending between said side members and said powered movement means including a first hydraulic cylinder extending between said top member and said plate, a mounting arm connected to said movable jaw, a slot formed in said plate and receiving said mounting arm slidably therein, said jaw movement means including a second hydraulic cylinder connected to said mounting arm.

2. The post puller of claim 1 wherein said frame includes a pair of vertically disposed side members, and further including a mounting boss attached to each of said side members, a cross member attached between said side members, a third mounting point attached to said cross member.

3. The pulling device of claim 1 wherein said mounting arm includes an enlarged end on the opposite side of said plate from said movable jaw, guide means at least partially surrounding said enlarged head for guiding said arm along a path of travel through said slot, said second hydraulic cylinder being attached to said enlarged head.

4. In combination with an upright frame including a pair of upright side members, a pair of sleeve members slidably mounted on said side members therealong, an edge upstanding plate extending and secured between said sleeve members, an outstanding fixed jaw carried by and projecting outwardly of one side of said plate between said sleeve members and adjacent one sleeve member and facing toward the other sleeve member, said plate having a horizontal slot formed therethrough between said fixed jaw and said other sleeve member, said other side of said plate having elongated guide structure supported therefrom extending along said slot, an elongated movable jaw extending and slidable through said slot including a head on one end guidingly engaged with said guide structure and with the other end of said movable jaw opposing and movable toward and away from said fixed jaw, and motor means operatively connected between said head and one of said sleeves for shifting said head along said guide structure and said jaw through said slot.

5. The combination of claim 4 wherein said upright frame includes upper and lower transverse members extending and connected between the upper and lower ends of said upright side members, motor means operatively connected between said upper transverse member and said plate for shifting the latter along said upright side members, one side of said frame including anchor structure for attachment to the three point hitch of a tractor.

* * * * *